US005133638A

United States Patent [19]

Mosure

[11] Patent Number: 5,133,638

[45] Date of Patent: Jul. 28, 1992

[54] CENTRIFUGAL PUMP DIFFUSER RING ASSEMBLY

[75] Inventor: Duane C. Mosure, Poplar Grove, Ill.

[73] Assignee: Sundstrand Corporation, Rockford, Ill.

[21] Appl. No.: 552,723

[22] Filed: Jul. 16, 1990

[51] Int. Cl.[5] ..... F01D 11/00; F04D 1/00

[52] U.S. Cl. ..... 415/168.1; 415/208.3; 415/211.2; 415/214.1

[58] Field of Search ..... 415/208.1, 208.2, 208.3, 415/209.2, 211.2, 168.1, 168.2, 214.1, 207, 224, 224.5, 212.1, 213.1, 58.4, 58.6

[56] References Cited

U.S. PATENT DOCUMENTS

| | | | |
|---|---|---|---|
| 2,865,539 | 12/1958 | Edwards | 415/58.4 |
| 3,426,964 | 2/1969 | Silvern | 415/204 |
| 3,549,277 | 12/1970 | Kiss et al. | 415/168.2 |
| 4,586,872 | 5/1986 | Corzilius et al. | 415/214.1 |
| 4,826,402 | 5/1989 | Nachtrieb | 415/206 |

*Primary Examiner*—John T. Kwon
*Assistant Examiner*—Hoang Nguyen
*Attorney, Agent, or Firm*—Harold A. Williamson

[57] ABSTRACT

This invention relates to a unitary centrifugal fluid fuel pump diffuser ring assembly for use between a low pressure source of fluid on a fluid input side of the diffuser ring and a high pressure fluid exit side of the diffuser ring. In the preferred embodiment of the invention a diffuser ring is disposed in mating engagement between a pair of support structures. The diffuser ring is provided with separate fluid sealing units disposed between a first and a second side of the diffuser ring. The fluid sealing units cooperate with the support structures to provide on the first and the second sides of the diffuser ring regions which are free from the effects of the aforenoted low and high pressures. This arrangement results in a reduction in the force required to hold the diffuser ring and the support structures in a unitary assembly free of fluid leakage.

12 Claims, 2 Drawing Sheets

FIG. 1
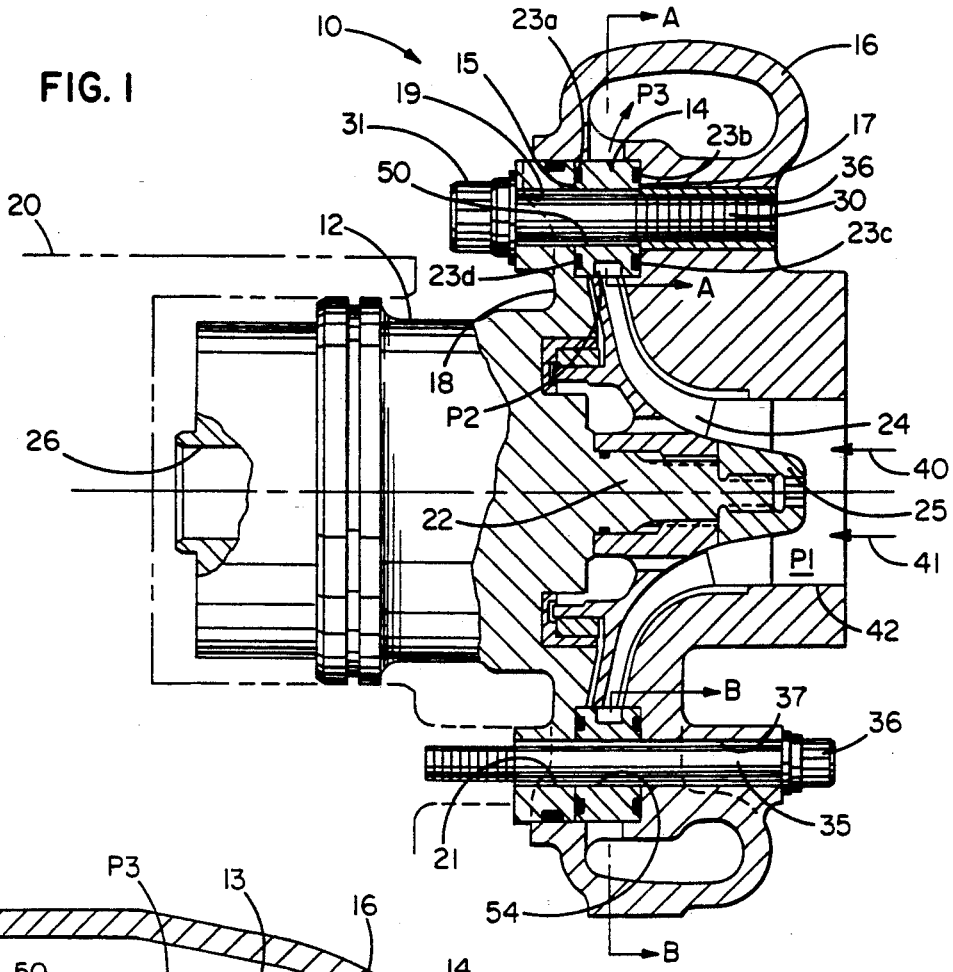
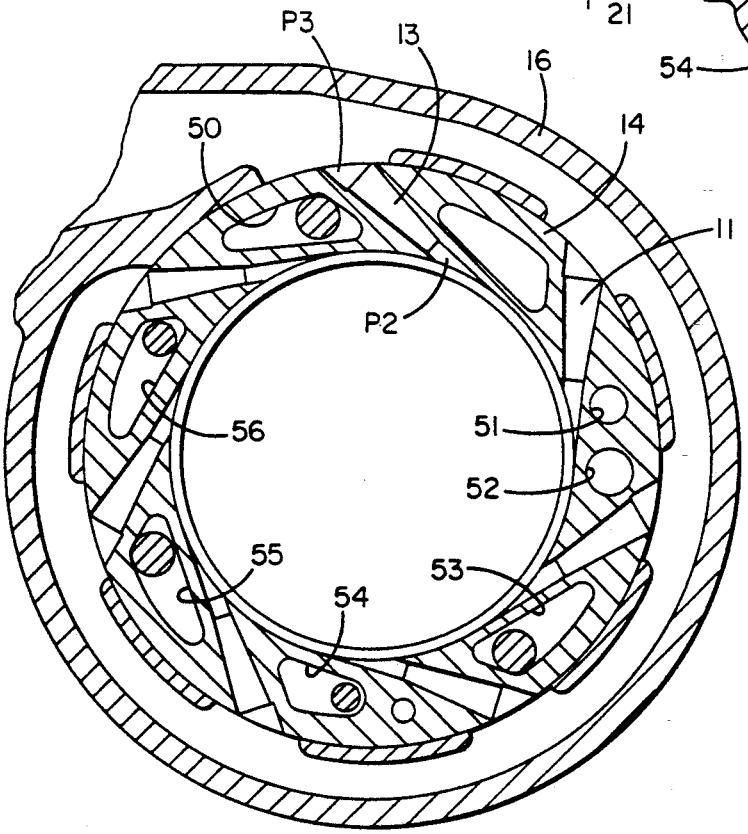
FIG. 2

CENTRIFUGAL PUMP DIFFUSER RING ASSEMBLY

TECHNICAL FIELD

This invention relates to a sealing arrangement for a diffuser ring assembly in a centrifugal pump.

BACKGROUND ART

High pressure centrifugal fuel pumps for use in an aerospace environment are required to be light in weight and extremely rugged in their construction. Moreover, every additional ounce of weight that can be removed from such a fuel pump is an ounce of weight that does not have to be carried aloft over the life of the aircraft. Current aircraft remain airworthy for twenty years or more. The fuel cost per ounce of aircraft weight just to maintain the aircraft aloft for more than twenty years is significant and measurable in dollars and cents.

The use of unitary diffuser rings in centrifugal compressors as in the K. H. Wieland U.S. Pat. No. 4,302,150, where the medium being pumped is a gas, is common.

High pressure liquid pumps of the centrifugal type that include diffuser rings in conjunction with a pump impeller and high pressure fluid delivery volute are typical as shown by the Cygnor et al U.S. Pat. No. 4,417,851, and the Schaefer U.S. Pat. No 4,714,405, both of which are assigned to the same assignee as the subject invention.

In high pressure fuel pumps, the diffuser rings are typically clamped between pump support structures and held in a unitary assembly by means of bolts that pass through the diffuser ring and secure the ring to the support structures. Because of the extremely high fluid pressures in and about the diffuser ring assembly, pump fastening bolts are frequently inserted through openings in the diffuser ring at points between adjacent diffuser throats.

It has been discovered that the tremendous loads experienced by the pump fastening bolts find their origin in the fact that while the diffuser ring is clamped between support structures, surfaces of the diffuser ring adjacent the support structures are wetted by the fluid being pumped. These wetted faces of the diffuser ring are exposed to a range of fluid pressures from the fluid that exits at pump impeller and the pressure at an exit end of a diffuser throat of the diffuser ring. It will be appreciated that when these just described fluid pressures are present over a diffuser ring surface, a force equal to the product of the area of the diffuser ring face times the fluid pressures over the diffuser ring surface will be present. The just described force must be accommodated by the pump fastening bolts. None of the U.S. patents cited hereinbefore appear to recognize this just described force nor do they suggest any way to reduce such a force, as the instant invention does, in a manner to be describe hereinafter, thereby allowing for the reduction in size and number of the pump fastening bolts.

DISCLOSURE OF THE INVENTION

More specifically, this invention relates to a unitary centrifugal fluid fuel pump diffuser ring assembly for use between a low pressure source of fluid on a fluid input side of the diffuser ring and a high pressure fluid exit side of the diffuser ring. In the preferred embodiment of the invention to be described more fully hereinafter, a diffuser ring is disposed in mating engagement between a pair of support structures. The diffuser ring is provided with separate fluid sealing units disposed between a first and a second side of the diffuser ring. The fluid sealing units cooperate with the support structures to provide on the first and the second sides of the diffuser ring regions which are free from the effects of the aforenoted low and high pressures. This arrangement results in a reduction in the force required to hold the diffuser ring and the support structures in a unitary assembly free of fluid leakage.

It is therefore a primary object of the invention to significantly reduce the internal pressure forces which contribute to centrifugal pump split line separation.

It is yet another object of this invention to significantly reduce the number and size of fasteners employed in maintaining a high pressure centrifugal pump as a leak-free unitary assembly.

Still another object of the invention is to provide a high pressure output pump that is light in weight, rugged in construction, and that can be manufactured at a reduced cost.

In the attainment of the foregoing objects, the invention contemplates in its preferred embodiment a unitary centrifugal fluid pump that has a diffuser ring assembly positioned within the pump between a low pressure source on a fluid input side of the diffuser ring and a high pressure fluid exit side of the diffuser ring.

The diffuser ring, which has parallel first and second sides, is disposed in mating engagement between a pair of support structures, one of which may be a volute housing.

The diffuser ring first and second sides are each provided with fluid sealing units which, in the preferred embodiment, take the form of pairs of "O" rings. One of each of the "O" rings is positioned on the first and second diffuser ring sides adjacent the low pressure source and the high pressure fluid exit side of the diffuser ring. This "O" ring configuration just described provides a region on the first and second sides of the diffuser ring that is free from the effects of the low and high pressures which results in a reduction in a force required to hold the diffuser ring and the support in a unitary, leak-free assembly.

The preferred embodiment of the invention contemplates that the pump will be fastened together in a unitary structure by means of a bolt fastener which passes through one of the pair of support structures, as well as the diffuser ring in the regions between the "O" rings on the diffuser ring. The bolt is threadably secured to the other support structure.

Another embodiment of the invention completely avoids the need for fastening bolts by providing an externally threaded mechanical fastener which cooperates with the volute housing and one of the support structures to apply a compression force upon the diffuser ring by the pair of support structures thereby assuring a unitary, leak-free assembly.

Other objects and advantages of the present invention will be apparent upon reference to the accompanying description when taken in conjunction with the following drawings:

BRIEF DESCRIPTION OF THE DRAWINGS

FIG. 1 is a partial cross section of a centrifugal pump which embodies the invention, and FIG. 2 is a partial section of FIG. 1 showing a cross section of an entire diffuser ring and a portion of a volute housing external to a diffuser ring;

BEST MODE FOR CARRYING OUT THE INVENTION

Figure 3:
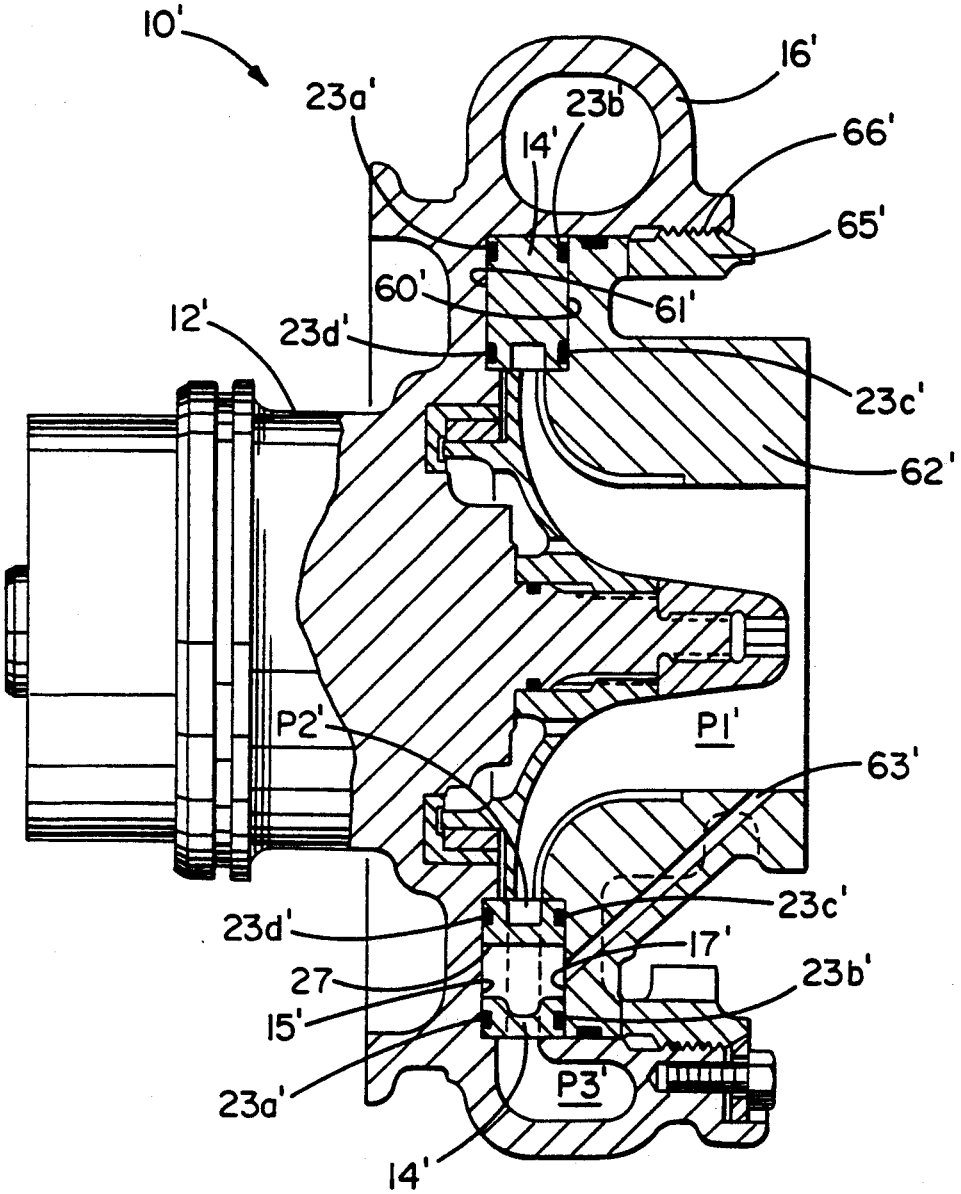
FIG. 3 is a partial section of centrifugal pump which includes another embodiment of the invention.

Reference is now made to FIG. 1 which illustrates in section a preferred embodiment of the invention.

A centrifugal fuel pump 10 generally indicated by an adjacent arrow includes a bearing housing 12, a diffuser ring 14, and a volute housing 16 disposed in the relationship shown in FIG. 1. The bearing housing 12 is shown mounted in a gear box 20 as indicated by the solid and broken lines depicted in FIG. 1.

The bearing housing 12 further includes annular flange element 18.

In practice the annular flange is a continuous element which includes a plurality of flange openings therethrough, two of which flange openings 19, 21 are shown in section in FIG. 1. The total number of flange openings will be better appreciated upon study and explanation of FIG. 2 hereinafter.

The bearing housing 12 has mounted for rotation therein an impeller shaft 22 which carries secured thereto in a wholly conventional fashion a pump impeller 24 fastened in place by pump fastener 25. The impeller shaft 22 is driven by a gear box output drive shaft (not shown) which drive shaft engages a splined opening 26 in a schematically shown end portion of impeller shaft 22.

It will be observed that the pump impeller 24 terminates immediately adjacent the diffuser ring 14. The annular flange 18 and volute housing 16 are provided with annularly disposed recessed regions 15, 17 into which the diffuser ring 14 matingly fits. "O" ring **23*a*, 23*d*, and 23*b*, 23*c* provide a fluid seal in the recessed regions 15, 17 between the diffuser ring 14, annular flange 14, and volute housing 16**.

A pump fastening bolt 30 is shown threaded into volute housing 16. It is to be noted that the bolt 30 includes a bolt head 31 which is adjacent the gear box 20 when centrifugal pump 10 is installed for use in the gear box 21.

The entire pump 10 is threadably secured to the gear box 20 by a number of gear box fastening bolts, one of which 35 is seen in FIG. 1. The gear box fastening bolt 35 has a bolt head 36 positioned on a side of the fuel pump 10 which is opposite a pump fastening head 31. The advantageous significance of this just described relationship will be set forth in greater detail hereinafter.

In operation the fuel pump 10 receives fuel shown by arrows 40, 41 at a pressure $P_1$ as indicated at pump inlet 42. The pump impeller delivers fuel at an elevated pressure $P_2$ to diffuser ring 14. Fuel exiting the diffuser ring 14 is at pressure $P_3$ which is at a yet higher pressure than $P_2$.

Attention is now directed to FIGS. 1 and 2 for the description that ensues. More specifically, FIG. 2 shows in section generally along lines A—A and B—B of FIG. 1 the volute housing 16 and diffuser ring 14. The diffuser ring 14 includes a plurality of typical diffusers 11, 13, two of which are referenced. The pump impeller 24 and its related pump impeller fastener 25 are not shown in FIG. 2 to facilitate the reader's appreciation of the cooperative relationship of the volute housing 16 and diffuser ring 14.

The diffuser ring includes a plurality of openings 50, 51, 52, 53, 54, 55, and 56 which openings correspond to an equal number of openings in the annular flange 18. More specifically, diffuser ring opening 50 corresponds to annular flange opening 19, see FIG. 1, whereas diffuser ring opening 54 corresponds with annular flange opening 21, see FIG. 1.

The volute housing 16 as best seen in FIG. 1 includes volute housing openings, such as openings 36, 37, which correspond in number with diffuser ring openings 50, 51, 52, 53, 54, 55, and 56.

In the preferred embodiment of the invention diffuser ring openings 50, 52, 53, and 55 receive pump fastening bolts of the same type as pump fastening bolt 30 described earlier, whereas diffuser ring openings 51, 54, and 56 received gear box fastening bolts of the same type as gear box fastening bolt 35 described earlier.

This just described arrangement which makes simultaneous use of gear box mounting bolts to enhance and ensure that the pump described remains leak free, even should a pump fastening bolt be missing or under torqued, represents an advance of the present art is the focus of co-pending U.S. patent application (B04019).

Additionally, the location of the pump fastening bolt heads such as bolt head 31 immediately adjacent the annular flange 18 and proximate the gear box 20 ensures that when the fuel pump 10 is installed the pump fastening bolts are inaccessible to conventional tools and cannot be actuated.

Reference is now made to FIG. 3 which illustrates another embodiment of the invention. In the description that follows, reference numerals which identify similar components, as in FIGS. 1 and 2, will be given the same reference number but be distinguished by the addition of a prime marking adjacent thereto. Accordingly, the centrifugal pump 10 of FIG. 1 will be designated in FIG. 3 as centrifugal pump 10'.

In FIG. 3 the bearing housing 12' and volute housing 16' are integrated into a unitary structure of the configuration shown in the drawing.

The operation of the pump in FIG. 3, which has been set forth in some detail with respect to FIGS. 1 and 2, will not be repeated again here.

In viewing the FIG. 3 section, it should be apparent that there are no pump bolt fasteners employed in this embodiment of the invention.

The diffuser ring 14' is positioned within the pump between a low pressure source $P_2'$ on a fluid input side of the diffuser ring and a high pressure fluid $P_3'$ on the exit side of the diffuser ring.

Studying the diffuser ring 14' as shown in section on an upper portion of FIG. 3, it will be observed that the diffuser ring 14' has parallel first and second sides 60', 61' disposed in mating engagement between a recessed portion of volute housing 16' and an annular diffuser ring support structure 62'.

The diffuser ring first and second sides 60', 61' are each provided with fluid sealing units which, in the preferred embodiment, take the form of pairs of "O" rings **23*a*, 23*d* and 23*b*, 23*c*. One of each of the "O" rings, e.g. 23*d*, 23*c* is positioned on the first and second diffuser ring sides adjacent the low pressure source $P_2$ and the other "O" ring pair 23*a*', 23*b*'** are adjacent the high pressure fluid exit side of the diffuser ring. This "O" ring configuration just described provides a region on the first and second sides of the diffuser ring that is free from the effects of the low and high pressures which results in a reduction in a force required to hold the diffuser ring and the support in a unitary, leak-free assembly.

Attention is now directed to the sectioned detail of the diffuser ring 14' shown at the bottom of FIG. 3. It is significant to note that in this embodiment, the diffuser ring 14' is provided with a passageway 27 that communicates with recessed regions 15' and 17' of the support structure immediately adjacent the ring diffuser.

A fluid transfer conduit 63' is provided in the annular diffuser ring support structure 62 to connect the region between the "O" ring pair seals **23*b'*, 23*c'*, and 23*a'*, 23*d'*** and a pump inlet pressure $P_1'$ which pressure is lower than either $P_2'$ or $P_3'$.

The fluid transfer conduit 63' thereby ensures that should any fluid leakage occur at the parallel first and second sides 61', 62', the leakage would be returned to the pump inlet for recirculation.

The last feature of the invention to be reviewed in respect of FIG. 3 involves a mechanical fastener 65' that cooperates with the volute housing 16' and the annular support structure 62' to apply a compressive force upon the diffuser ring 14'. The mechanical fastener 65' has an externally threaded poprtion 66' that provides the mechanical advantage required to secure the pump assembly 10' into a leak-free unitary structure.

Although this invention has been illustrated and described in connection with the particular embodiments illustrated, it will be apparent to those skilled in the art that various changes may be made therein without departing from the spirit of the invention as set forth in the appended claims.

I claim:

1. A unitary centrifugal fluid pump diffuser ring assembly for use between a low pressure source on a fluid input side of said diffuser ring and a high pressure fluid exit side of said diffuser ring, said assembly comprising:

a diffuser ring disposed in mating engagement between a pair of support structures, said diffuser ring having separate fluid sealing means disposed between a first and a second side of said diffuser ring and each of said support structures to thereby provide a region on said first and said second sides of said diffuser ring which is free from the effects of said low and said high pressures which result in a reduction in a force required to hold said diffuser ring and said support structures in a unitary assembly free of fluid leakage.

2. The diffuser ring assembly of claim 1 wherein said diffuser ring first and second sides are parallel to each other.

3. The diffuser ring assembly of claim 2 wherein said separate fluid sealing means are comprised of a pair of "O"-ring means on each of said first and second sides.

4. The diffuser ring assembly of claim 3 wherein one of each of said pairs of "O"-ring means is positioned on one of said first and second diffuser ring sides adjacent said low pressure source and said high pressure fluid exit side of said diffuser ring, said region free of the effects of said low and high pressures being present between said pair of "O"-ring on each side of said diffuser ring.

5. The diffuser ring assembly of claim 4 wherein one of said pair of support structures is a portion of a volute housing containing said high pressure fluid.

6. The diffuser ring assembly of claim 3 wherein a pump fastening means is provided to secure said pair of support structures and said diffuser ring together as said unitary assembly.

7. The diffuser ring assembly of claim 6 wherein said pump fastening means is an elongated fastening element which passes through one of said pair of support structures, said diffuser ring and is secured to another of said pair of support structures.

8. The diffuser ring assembly of claim 7 wherein said elongated fastening element intersects said regions on said first and said second sides of said diffuser ring.

9. The diffuser ring assembly of claim 8 wherein said elongated fastening element is a bolt having an end thereof threaded into said other of said pair of support structures.

10. The diffuser ring assembly of claim 6 wherein said pump fastening means is a mechanical fastener means which cooperates with said volute housing and said one of said pair of support structures to apply a compressive force upon the said diffuser ring by said pair of support structures thereby ensuring said leak-free unitary assembly.

11. The diffuser ring assembly of claim 10 wherein said mechanical fastening means includes a threaded annular member that matingly engages a like threaded portion on said volute housing.

12. The diffuser ring assembly of claim 6 wherein fluid transfer means are provided from a point in at least one of said diffuser ring regions to a location that is at a fluid pressure lower than said low pressure on said fluid input side of said diffuser ring.

* * * * *